US007893791B2

(12) United States Patent
Ma et al.

(10) Patent No.: US 7,893,791 B2
(45) Date of Patent: Feb. 22, 2011

(54) GALLIUM NITRIDE SWITCH METHODOLOGY

(75) Inventors: Yin Tat Ma, Thousand Oaks, CA (US); Jonathan Hacker, Thousand Oaks, CA (US); Karim S. Boutros, Malibu, CA (US)

(73) Assignee: The Boeing Company, Chicago, IL (US)

( * ) Notice: Subject to any disclaimer, the term of this patent is extended or adjusted under 35 U.S.C. 154(b) by 181 days.

(21) Appl. No.: 12/256,321

(22) Filed: Oct. 22, 2008

(65) Prior Publication Data

US 2010/0097119 A1 Apr. 22, 2010

(51) Int. Cl.
*H01P 1/10* (2006.01)
*H01P 5/12* (2006.01)

(52) U.S. Cl. ..... 333/104; 333/134

(58) Field of Classification Search ..... 333/101, 333/103, 104, 262, 134
See application file for complete search history.

(56) References Cited

U.S. PATENT DOCUMENTS 5,159,297 A * 10/1992 Tateno ..... 333/104
5,990,580 A 11/1999 Weigand
7,088,204 B2 8/2006 Kanno
7,368,971 B2 5/2008 Pengelly
7,411,471 B2 * 8/2008 Tsukahara ..... 333/104
7,453,329 B2 * 11/2008 Inoue ..... 333/81 A
7,511,592 B2 * 3/2009 Inoue ..... 333/104
2002/0075614 A1 6/2002 Li
2002/0130720 A1 9/2002 Pavio
2003/0025487 A1 2/2003 Jian et al.
2003/0112102 A1 6/2003 Wang
2003/0122079 A1 7/2003 Pobanz
2003/0130720 A1 7/2003 DePalma
2004/0070455 A1 4/2004 Hong
2004/0110469 A1 6/2004 Judd
2004/0124942 A1 7/2004 Kanno
2005/0122173 A1 6/2005 Floyd
2005/0280486 A1 12/2005 Kanno
2006/0091959 A1 5/2006 Chow
2006/0108664 A1 5/2006 Samelis
2006/0152306 A1 7/2006 Ito (Continued)

FOREIGN PATENT DOCUMENTS

EP 0 609 746 A1 8/1994

OTHER PUBLICATIONS

Caverly et al., Gallium Nitride: Use in High Power Control Applications, IEEE GaAs Digest, 2002 IEEE, (4 pgs).

(Continued)

*Primary Examiner*—Dean O Takaoka
(74) *Attorney, Agent, or Firm*—Toler Law Group

(57) ABSTRACT

Devices and systems for using a Gallium Nitride-based (GaN-based) transistor for selectively switching signals are provided. A first transmission line is configured to connect a common connection and a first connection. A first Gallium-Nitride-based (GaN-based) transistor has a first terminal coupled to the first transmission line at a first point, a second terminal coupled to a relative ground, and a third terminal configured to be coupled to a first control connection. A second GaN-based transistor has a first terminal coupled to the first transmission line at a second point, a second terminal configured to be coupled to the relative ground, and a third terminal configured to be coupled to the first control connection.

20 Claims, 6 Drawing Sheets

U.S. PATENT DOCUMENTS

| | | | |
|---|---|---|---|
| 2006/0197106 | A1 | 9/2006 | Mizutani |
| 2007/0018247 | A1 | 1/2007 | Brindle |
| 2007/0018720 | A1 | 1/2007 | Wright |
| 2007/0024389 | A1 | 2/2007 | Mizutani |
| 2007/0030101 | A1 | 2/2007 | Mizutani |
| 2007/0080750 | A1 | 4/2007 | Liebenrood |
| 2007/0114568 | A1 | 5/2007 | Simin |
| 2007/0126492 | A1 | 6/2007 | Pengelly |
| 2007/0216501 | A1 | 9/2007 | Tsai |
| 2007/0222523 | A1 | 9/2007 | Arell |
| 2008/0099802 | A1 | 5/2008 | Vice |
| 2008/0100404 | A1 | 5/2008 | Vice |
| 2008/0129427 | A1 | 6/2008 | Mun et al. |

OTHER PUBLICATIONS

Adesida et al., GaN Electronics with High Electron Mobility Transistors, Proc. 24th International Conference on Microelectronics, vol. 1, Serbia, May 2004 (8 pgs).

Carroll, Using GaN FETs for High Power RF Switches, IEEE Compound Semiconductor Symposium, Jun. 6, 2008 (4 pgs).

International Search Report and Written Opinion of the International Searching Authority, Int. Application No. PCT/US2009/059645, Dec. 23, 2009 (12 pgs).

Shedlock et al., Optimization of a RSD X-Ray Backscatter System for Detecting Defects in the Space Shuttle External Tank Thermal Foam Insulation, University of Florida—Nuclear & Radiological Engineering, (12 pgs), Sep. 16, 2005.

Ma et al., High Power AlGaN/GaN Ku-Band MMIC SPDT Switch and Design Consideration, Teledyne Scientific Company, (4 pgs), Jun. 2008.

* cited by examiner

GALLIUM NITRIDE SWITCH METHODOLOGY

FIELD OF THE DISCLOSURE

The present disclosure is generally related to utilizing high power transistors, such as Gallium Nitride (GaN) transistors, in switching applications.

BACKGROUND

In many switching applications, it may be desirable to use transistorized switches capable of handling large quantities of power without sustaining damage. Transistorized switches are small, fast, and generally require little power to open or close the state of the switches. For example, in a radio transceiver system, it may be desirable to use a transistorized switch to couple a transceiver to its antenna if the transistorized switch is capable of handling the anticipated power output of the transceiver or the anticipated power input from the antenna.

Transistors capable of accommodating high-power signals, however, tend to present some disadvantages. For example, high-power transistorized switches tend to have a high insertion loss, resulting in significant power loss when the switch is first activated. To take one specific example, although Gallium Nitride-based (GaN-based) field effect transistors (FETs) can accommodate high-power signals, GaN-based FETs have a high contact resistance and, thus, tend to have a high insertion loss. To overcome the insertion loss, a larger GaN-based FET could be used. However, using a larger GaN-based FET increases parasitic capacitance across the GaN-based FET. The coupling of the parasitic capacitance results in relatively poor isolation across the GaN-based FET when the GaN-based FET is turned off.

SUMMARY

Devices and systems for using a Gallium Nitride-based (GaN-based) transistor for selectively switching signals are provided. GaN-based transistors can accommodate high-power signals and thus are appropriate for high-power switching applications such as in switching radio signals or other communications signals. In one embodiment, a switching device using GaN-based transistors is configured using two or more GaN-based transistors in a shunt configuration with a transmission line. The transmission line extends from a common point, such as an antenna terminal, for example, to either a receive side of a transceiver or a transmit side of a transceiver. For example, in order to isolate the receive side of the transceiver from the transmit side of the transceiver, a first transmission line may selectively couple the receive side of the transceiver to the antenna terminal, while a second transmission line may selectively decouple the transmit side of the transceiver to the antenna terminal. The GaN-based transistors are used to selectively couple and decouple the first transmission line and second transmission line from the antenna terminal.

Using the GaN-based transistors in a shunt configuration allows each of the transmission lines of the transceiver to be selectively decoupled from a relative ground, effectively connecting the respective transmission line, or selectively coupling the transmission line to the relative ground and effectively disconnecting the respective transmission line. For example, used in a shunt configuration, a first terminal of the GaN-based transistor, e.g., the drain of the GaN-based transistor, is coupled to a transmission line while a second terminal of the GaN-based transistor, e.g., the source of the GaN-based transistor, is coupled to a relative ground. Based on the signal applied to control terminal of the GaN-based transistor, e.g., the gate of the GaN-based transistor, the GaN-based transistor will either be on or off, resulting in the transistor either behaving as a closed switch that conducts a current between its drain and source, or behaving as an open switch that does not conduct a current.

When the GaN-based transistor is off, the transmission line is not coupled to the relative ground, and a signal applied to the transmission line passes through the transmission line as though the GaN-based transistor were not present. On the other hand, when the GaN-based transistor is on, the GaN-based transistor couples the transmission line to the relative ground, thereby "shunting" the signal from the transmission line to ground and effectively disconnecting the transmission line. Using the GaN-based transistors in a shunt configuration reduces insertion loss upon opening the GaN-based transistor of the switching device to close the transmission line and improves isolation upon closing the GaN-based transistor of the switching device to effectively disconnect the transmission line.

The switching device further improves isolation by including one or more quarter-wavelength connection lengths in the transmission lines. When the transmission line is shunted to ground by a GaN-based transistor and a quarter-wavelength connection length is presented between the shunt transistor and the remainder of the switching device, the quarter-wavelength connection length causes the remainder of the switching device to see to an open circuit in place of the remainder of the switching device beyond the quarter-wavelength connection length.

In one particular embodiment, a device includes a first transmission line configured to connect a common connection and a first connection. A first Gallium-Nitride-based (GaN-based) transistor has a first terminal coupled to the first transmission line at a first point, a second terminal coupled to a relative ground, and a third terminal configured to be coupled to a first control connection. A second GaN-based transistor has a first terminal coupled to the first transmission line at a second point, a second terminal configured to be coupled to the relative ground, and a third terminal configured to be coupled to the first control connection.

In another particular embodiment, an electronic device includes a first Gallium Nitride-based (GaN-based) transistor having a first terminal and a second GaN-based transistor having a first terminal. A transmission line connects a common connection and a first connection. The first and second transistors are disposed in a pi-configuration with the transmission line being disposed between the first terminal of the first GaN-based transistor and the first terminal of the second GaN-based transistor. The first GaN-based transistor and the second GaN-based transistor are configured in a shunt configuration with the transmission line.

In still another embodiment, a system includes a first electronic device that includes a first GaN-based transistor, a second GaN-based transistor, and a first transmission line. The first transmission line connects a common connection to a first connection. The first GaN-based transistor and the second GaN-based transistor are disposed in a pi-configuration to selectively couple the first transmission line to a relative ground. The system also includes system includes a second electronic device that includes a third GaN-based transistor, a fourth GaN-based transistor, and a second transmission line. The second transmission line connects a common connection to a second connection. The third GaN-based transistor and the fourth GaN-based transistor are disposed in a pi-configuration to selectively couple the second transmission line to the relative ground.

The features, functions, and advantages that have been discussed can be achieved independently in various embodiments or may be combined in yet other embodiments further details of which can be seen with reference to the following description and drawings.

DETAILED DESCRIPTION

Figure 1:
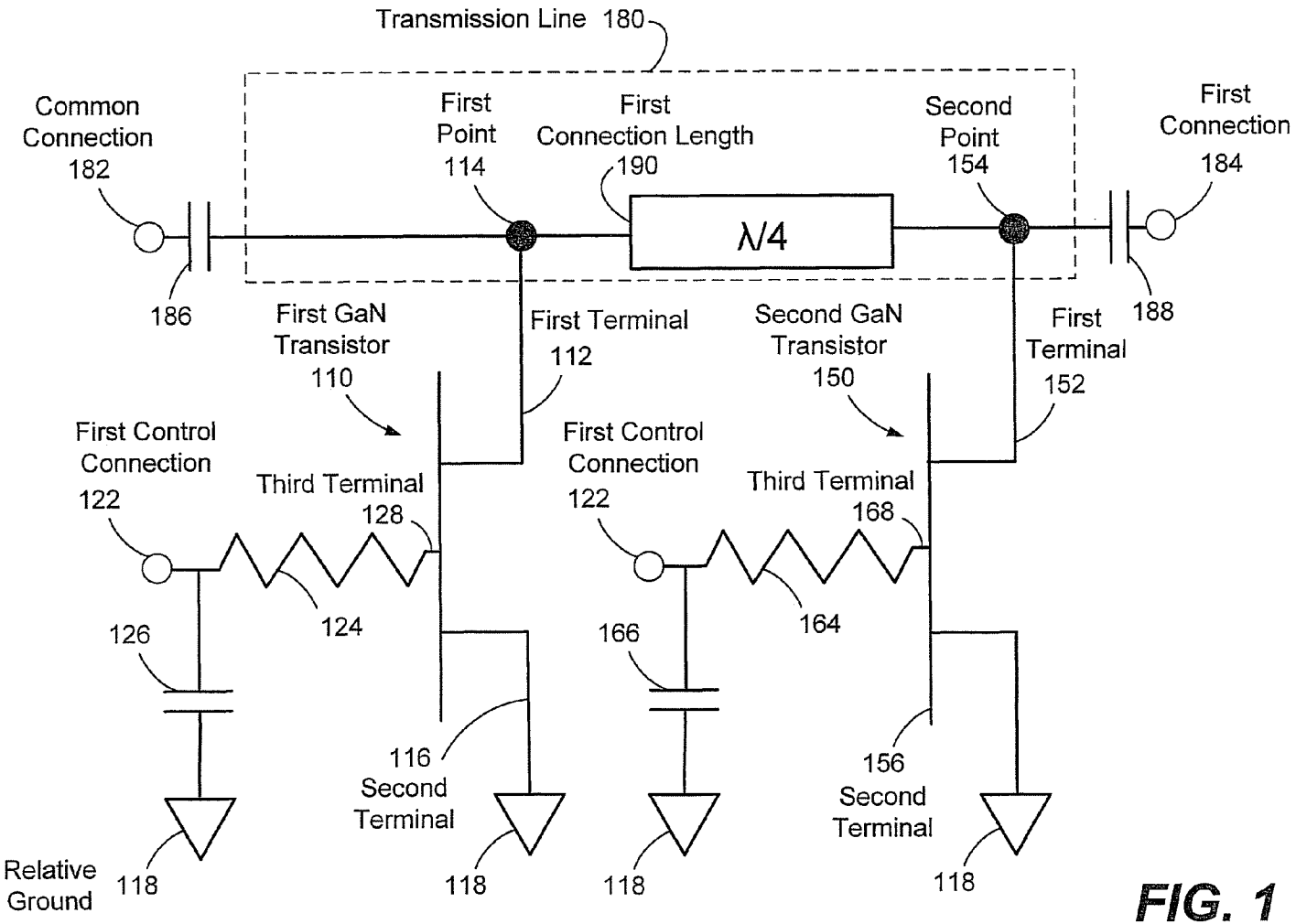
FIG. 1 is a schematic diagram of a first embodiment of a switching device including a pair of Gallium Nitride-based (GaN-based) transistors.

FIG. 1 depicts a schematic diagram of a first embodiment of a device, generally designated 100. The device 100 includes a pair of Gallium Nitride-based (GaN-based) transistors 110 and 150 configured in a pi-configuration. In the pi-configuration of FIG. 1, the GaN-based transistors 110 and 150 are both connected to a transmission line 180 in a shunt arrangement. In another particular embodiment, as described below, a device may include multiple pairs of GaN-based transistors. The configuration of the device 100 of FIG. 1 is suitable for use as a single-pole, single-throw (SPST) switch.

In one particular embodiment, the GaN-based transistors, such as the first GaN-based transistor 110 and the second GaN-based transistor 150 included in the device 100, include high electron mobility transistor (HEMT) devices. GaN-based HEMT devices are capable of handling high power loads without suffering damage. Even small GaN-based HEMT devices on the order of a few hundred micrometers are capable of passing signals of ten watts or more without sustaining damage. As a result, GaN-based HEMT devices are desirable for use in signal transmission or reception applications where, for example, a microwave transceiver may generate a transmission signal carrying many watts of power. A GaN-based HEMT device may be used to couple a transceiver output to an antenna and pass high-power transmission signals from the transceiver to the antenna without sustaining damage.

Referring to FIG. 1, in a particular embodiment, the first GaN-based transistor 110 includes a first terminal 112, which represents a drain of the first GaN-based transistor 110, coupled at a first point 114 to the transmission line 180. The first GaN-based transistor 110 also includes a second terminal 116, which represents a source of the first GaN-based transistor 110, coupled to a relative ground 118. The first GaN-based transistor 110 also includes a third terminal 128, which represents a gate of the first GaN-based transistor 110, that is coupled to a first control connection 122. The first control connection 122 is coupled to the third terminal 128 with a resistor 124 and a capacitor 126 in a filter configuration to filter noise from the power supply.

The second GaN-based transistor 150 includes a first terminal 152, which represents a drain of the second GaN-based transistor 150, coupled at a first point 154 to the transmission line 180. The second GaN-based transistor 150 also includes a second terminal 156, which represents a source of the second GaN-based transistor 150, coupled to the relative ground 118. The second GaN-based transistor 150 also includes a third terminal 168, which represents a gate of the second GaN-based transistor 150 that, like the third terminal 128 of the first GaN-based transistor 110, is coupled to first control connection 122. The first control connection 122 is coupled to the third terminal 168 with a resistor 164 and a capacitor 166 in a filter configuration to filter noise from the power supply.

The transmission line 180 includes a common connection 182 and a first connection 184. The common connection 182 may be coupled to a common device, such as an antenna, that is used by systems (not shown) coupled to multiple devices 100, as further described below. In addition, the transmission line 180 also may be coupled to one or more of a first capacitor 186 and a second capacitor 188 to block direct current components of signals carried by the transmission line. The first capacitor 186 and the second capacitor 188 may be made part of the transmission line 180 or desired capacitors may be connected between the common connection 182 and an external device (not shown) or between the first connection 184 and another external device (not shown).

In one particular embodiment, the common connection 182 includes a transceiver input and/or output connection while the first connection 184 includes an antenna connection. Alternatively, the common connection 182 may include the antenna connection while the second connection 184 includes the transceiver input/output connection because, in the particular embodiment of FIG. 1, a signal may propagate through the transmission line 180 from the common connection 182 to the first connection 184 or from the first connection 184 to the common connection 182. As described further below, either the common connection 182 or the first connection 184 may include a common connection for two or more of the devices 100. The common connection 182 may, for example, couple systems connected by each of a pair of devices 100 to an antenna. A first connection 184 of a first device 100 may be coupled to the transmit side of a transceiver and a first connection 184 of a second device 100 may be coupled to a receive side of the transceiver.

In such a configuration, the signal applied to the first control connection 122 of the device 100 determines whether the device will conduct signals between the common connection 182 and the first connection 184. Generally, when a logical high signal, as described further below, is applied to the first control connection 122, the first GaN-based transistor 110 and the second GaN-based transistor 150 shunt the transmission line 180 to ground and signals will not be conducted between the common connection 182 and the first connection 184. On the other hand, when a logical low signal is applied to the first control connection 122, the first GaN-based transistor 110 and the second GaN-based transistor 150 will be turned off and will function as open circuits that do not shunt the transmission line 180 to ground. In short, applying a logical high signal to the first control connection 122 causes the device 100 not to carry signals between the common connection 182 and the first connection 184, while applying a logical low signal to the first control connection causes the device 100 to carry signals between the common connection 182 and the first connection 184.

Alternatively, multiple devices 100 might be used, for example, if a single transceiver is selectively coupled to multiple different antennae or a single antenna is coupled to multiple transceivers. In such embodiments, multiple devices 100 can be used to selectively couple a common device at a common connection 182 with multiple other devices at other connections, as further described below.

In the particular embodiment shown, the transmission line 180 has a first connection length 190 between the first point 114 and the second point 154 where the first terminal 112 of the first GaN-based transistor 110 and the first terminal 152 of the second GaN-based transistor 150 are electrically coupled to the transmission line 180. In one particular embodiment, the first connection length 190 includes a quarter-wavelength (approximately one-quarter of an anticipated operating wavelength) connection length. Use of the quarter-wavelength first connection length improves isolation across the device 100. When the first GaN-based transistor 110 and the second GaN-based transistors 150 are turned on and thus shunt the transmission line 180 to the relative ground 118, the quarter-wavelength first connection length 190 causes devices at the first connection 184 operating at the anticipated operating wavelength to see an open circuit beyond second point 154. The quarter-wavelength first connection length 190 partially reflects the applied signal, improving the isolation of the device 100.

In one particular implementation, the device 100 is used to connect a transmitter (not shown) coupled to the device 100 at the first transmission connection 182 to an antenna (not shown) at the second transmission connection 184. When the transmitter transmits a signal, a first signal is applied to the first control connection 122 of the first GaN-based transistor 110 and the second GaN-based transistor 150. The first signal is a logical low signal at a low voltage. For example, in the case of some GaN-based transistors, the low voltage may include a voltage between negative ten (−10) volts and negative four (−4) volts. The first signal turns off both the first GaN-based transistor 110 and the second GaN-based transistor 150, causing both the first GaN-based transistor 110 and the second GaN-based transistor 150 to present open circuits between the transmission line 180 and the relative ground 118. As a result, the transmission line 180 presents a single conductive path between the common connection 182 and the first connection 184. The signal received from the transceiver is passed to the antenna as though the device 100 were simply a conductor.

On the other hand, when one of a transmit side or a receive side of the transceiver is not being used to send or receive a signal, respectively, or perhaps it is believed the transceiver is under a malicious attack from a high power signal intended to damage the transceiver, the device 100 can be used to isolate the transceiver. In this case, a second signal is applied to the first control connection 122 of the first GaN-based transistor 110 and the second GaN-based transistor 150. The second signal is a logical high signal at a high voltage. For example, in the case of some GaN-based transistors, the high voltage may include a voltage between zero (0) volts and one (1) volt. The control signal turns on both the first GaN-based transistor 110 and the second GaN-based transistor 150, causing both the first GaN-based transistor 110 and the second GaN-based transistor 150 to present closed circuits between the transmission line 180 and the relative ground 118. As a result, the transmission line 180 is shunted to the relative ground 118 between the common connection 182 and the first connection 184. Any incoming signal received at the first connection 184 is shunted to the relative ground 118 instead of being passed to the transceiver, thereby isolating the system coupled to the common connection 182 from the signal.

Thus, in sum, when a logical low signal or low voltage is presented at the first control connection 122, the device 100 enables the transmission line 180 to carry a signal between the common connection 182 and the first connection 184. On the other, hand, when a logical high signal or a high voltage is presented at the first control connection 122, the device 100 shunts the transmission line 180 to the relative ground 118 and, thus, prevents the transmission line 180 from carrying a signal between the common connection 182 and the first connection 184.

In the particular embodiment of the device 100 shown in FIG. 1, the use of two GaN-based transistors 110 and 150 provides improved isolation between the common connection 182 and the first connection 184. Using a single transistor to shunt the transmission line 180 may allow for some leakage across the shunt due to the finite transistor channel resistance. Using two transistors reduces the leakage by lowering the overall transistor finite resistance. In addition, the use of the quarter-wavelength first connection length 190 provides further isolation of the circuit by phase cancellation. An incoming signal received at the first connection 184 is presented with a shunt to the relative ground 118 at the second GaN-based transistor 150. Moreover, the quarter-wavelength first connection length 190 causes any device coupled to the common connection 182 to see the device 100, beyond the first point 114 from a perspective of the common connection 182, as an open circuit. As previously described, the quarter-wavelength first connection line length 190 coupled to another shunt by the first GaN-based transistor 110 coupled at the first point 114, results in any signal at or about the anticipated wavelength to be partially reflected. The partially-reflected signal thus causes the transmission line 180 and the rest of the device 100, beyond the second point 154 from a perspective of the first connection 184, to appear to be an open circuit, further isolating the transceiver coupled to the common connection 182 from the antenna coupled to the first connection 184.

Figure 2:
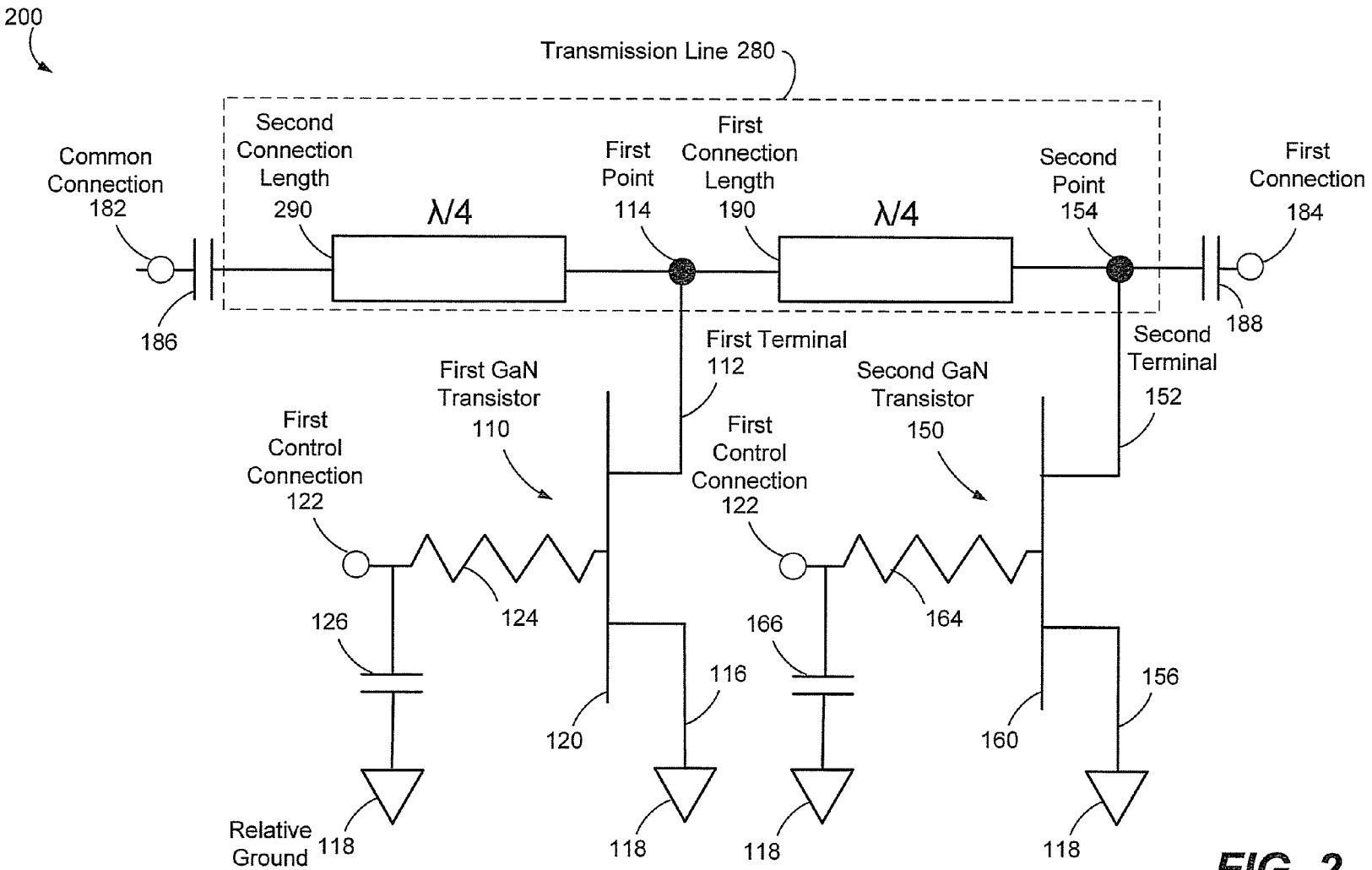
FIG. 2 is a schematic diagram of another particular embodiment of a switching device including a pair of GaN-based transistors.

FIG. 2 is a schematic diagram of another particular embodiment of a single-pole, single-throw (SPST) switching device 200 including a pair of GaN-based transistors. The device 200 includes all of the components included in the device 100 of FIG. 1, connected in the same way, with one exception. The device 200 also includes a second connection length 290 between the common connection 182 and the first point 114 at which the first GaN-based transistor 110 is coupled to the transmission line 280. In one particular embodiment, the second connection length 290 includes a quarter-wavelength transmission line length. As previously described, the inclusion of the quarter-wavelength connection length across a shunt to relative ground causes the transmission line 280 to appear to be an open circuit. Thus, when the first GaN-based transistor 110 and the second GaN-based transistor 150 are coupled to the relative ground 118, any device coupled to the common connection sees the transmission line 280 and the rest of the device 100 as an open circuit. Including two quarter-wavelength connection lengths 190 and 290 provides further isolation to the devices coupled to the common connection 182 and the first connection 184 regardless of which of the common connection 182 and the first connection 184 presents an incoming signal.

In the device 100 of FIG. 1 and the device 200 of FIG. 2, the quarter-wavelength connection lengths 190 and 290 are selected based on a range of one or more anticipated wavelengths to be used with the circuit. In one example, it is anticipated that the devices 100 and 200 will be used with frequencies in excess of 1 gigahertz (GHz). To take one example, a desired operating frequency range may include signals in a 17-18 GHz range. To determine the wavelength for such signals, the wavelength is equal to the speed of propagation of a signal in a medium divided by its frequency. Thus, in a vacuum where electromagnetic signals travel at the speed of light, the wavelength of a signal is equal to the speed of light divided by the frequency of the signal. In a semiconductor medium (or other non-vacuum medium), the speed of propagation is reduced. In a semiconductor medium, the speed of propagation can be determined by dividing the speed of light by the square root of the dielectric constant of the substrate material. Thus, for example, when the transmission line using a silicon carbon (SiC) substrate and the frequency is 17 GHz, a quarter-wave length connection length would be approximately 1.7 mm. Embodiments may be configured for use with lower or higher frequencies, and correspondingly longer and shorter wavelengths, by changing the quarter-wavelength transmission lengths 190 and 290.

As previously described, the device 100 of FIG. 1 and the device 200 of FIG. 2 represent single-pole, single-throw (SPST) switches. However, by coupling in parallel multiple devices 100 or 200, single-pole, double-throw (SPDT) or single-pole, multiple throw (SPMT) devices may be created as shown in FIG. 3.

Figure 3:
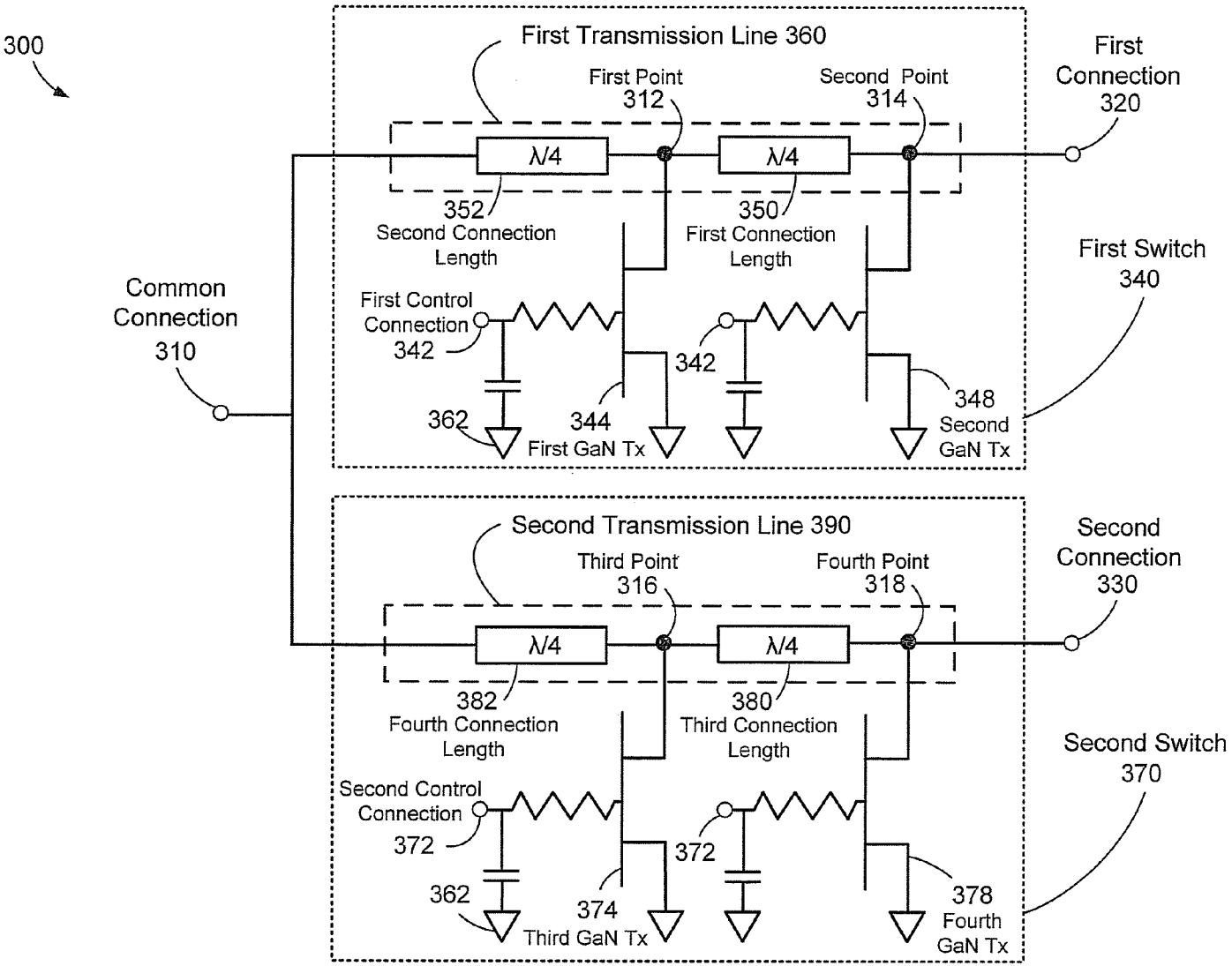
FIG. 3 is a schematic diagram of a particular embodiment of a switching device including two pairs of GaN-based transistors;.

FIG. 3 is a schematic diagram of a particular embodiment of a switching device 300 including two pairs of GaN-based transistors. The device 300 includes two of the device 200 of FIG. 2 (labeled as first switch 340 and second switch 370 in FIG. 3) in parallel to create a single-pole, double-throw (SPDT) switch. The device 300 may be used, for example, to separately couple a receive side and a transmit side of a transceiver to an antenna, to selectively couple a single transceiver to multiple different antennae, or to selectively couple multiple transceivers to a single antenna. The device 300 includes a common connection 310 that is selectively coupled via a first transmission line 360 of the first switch 340 to a first connection 320 and selectively coupled via a second transmission line 390 of the second switch 370 to a second connection 330.

In the device 300, the first switch 340 and the second switch 370 selectively couple the common connection 310 to neither, one, or both of the first connection 320 and the second connection 330. The first switch 340 includes a first GaN-based transistor (first GaN Tx) 344 having its drain coupled to the first transmission line 360 at a first point 312 and its source coupled to a relative ground 362. The first switch 340 also includes a second GaN-based transistor (second GaN Tx) 348 having its drain coupled to the first transmission line 360 at a second point 314 and its source coupled to a relative ground 362. A first control connection 342 is coupled to a gate of the first GaN-based transistor 344 of the first switch 340 and a gate of the second GaN-based transistor 348 of the first switch 340. Thus, the gates of the first GaN-based transistor 344 and the second GaN-based transistor 348 both receive a same input signal, as described with reference to FIG. 1. Depending on the input signal applied to the first control connection 342, both the first GaN-based transistor 344 and the second GaN-based transistor 348 either cause the first switch 340 to present a closed switch or an open switch. Specifically, when a logical low signal or low voltage as previously described is presented to the first control connection 342, both the first GaN-based transistor 344 and the second GaN-based transistor 348 are turned off, the first transmission line 360 is not shunted to the relative ground 362, and signals will be conducted between the common connection 310 and the first connection 320. On the other hand, when a logical high signal (as previously described) or high voltage is presented to the first control connection 342, both the first GaN-based transistor 344 and the second GaN-based transistor 348 are turned on, the first transmission line 360 is shunted to the relative ground 362, and signals will not be conducted between the common connection 310 and the first connection 320.

The second switch 370 includes a third GaN-based transistor (third GaN Tx) 374 having its drain coupled to the second transmission line 390 at a third point 316 and its source coupled to a relative ground 362. The second switch 340 also includes a fourth GaN-based transistor (fourth GaN Tx) 378 having its drain coupled to the second transmission line 360 at a fourth point 318 and its source coupled to a relative ground 362. A second control connection 372 is coupled to a gate of the third GaN-based transistor 374 and a gate of the fourth GaN-based transistor 378 of the second switch 370. Thus, the gates of the third GaN-based transistor 374 and the fourth GaN-based transistor 378 both receive a same input signal. As in the case of the first switch 340, depending on the input signal applied to the second control connection 372, both the third GaN-based transistor 374 and the fourth GaN-based transistor 378 either cause the second switch 340 to present a closed circuit or an open circuit. Specifically, when a logical low signal or low voltage is presented to the second control connection 372, both the third GaN-based transistor 374 and the fourth GaN-based transistor 378 are turned off, the second transmission line 390 is not shunted to the relative ground 362, and signals will be conducted between the common connection 310 and the second connection 330. On the other hand, when a logical high signal or high voltage is presented to the second control connection 372, both the third GaN-based transistor 374 and the fourth GaN-based transistor 378 are turned on, the second transmission line 390 is shunted to the relative ground 362, and signals will not be conducted between the common connection 310 and the second connection 330.

In one particular embodiment, the device 300 is configured to operate as an SPDT switch by causing a control signal received by the first control connection 342 of the first switch 340 to be the opposite of a control signal received by the second control connection 372 of the second switch 370. Thus, for example, the control signal received by the first control connection 342 may be a logical low signal at a low voltage, such as a signal between −4 volts and −10 volts as previously described with reference to FIG. 1, causing the first switch 340 to appear as a closed switch or a closed conductor. At the same time, the control signal received by the second control connection 372 may be a logical high signal at a high voltage, such as a signal between 0 volts and 1 volt as previously described with reference to FIG. 1, causing the second switch 370 to appear as an open circuit.

As a result of this SPDT configuration, the common connection 310 will be electrically coupled to either the first connection 320 via the first transmission line 360 or the second connection 330 via the second transmission line 390, while being isolated from the opposite connection. The use of quarter-wavelength connection lengths, including the first connection length 350 and the second connection length 352 in the first transmission line 360 and the third connection length 380, and the fourth connection length 382 in the second transmission line 390 help to improve isolation when the respective transmission lines 360 and 390 are disconnected.

As previously described, when the first GaN-based transistor 344 and the second GaN-based transistor 348 are turned on, the first transmission line 360 is shunted to the relative ground 362. Similarly, when the third GaN-based transistor 374 and the fourth GaN-based transistor 378 are turned on, the second transmission line 390 is shunted to the relative ground 362. With the first transmission line 360 and the second transmission line 390 shunted to the relative ground, the first connection length 350 in the first transmission line 360 and the third connection length 380 in the second transmission line 390 cause the first connection 320 and the second connection 330 to see an open circuit past the second point 314 in the first switch 340 and past the fourth point 318 in the second switch 370. Correspondingly, the first connection length 350 in the first transmission line 360 and the third connection length 380 in the second transmission line cause the common connection 310 to see an open circuit past the first point 312 of the first switch 340 and past the third point 316 of the second switch 370. Additionally, the second connection length 352 in the first transmission line 360 and the-fourth connection length 382 in the second transmission line 390 cause the common connection see an open circuit.

In other embodiments, the control signals provided to the first control connection 342 of the first switch 340 and the second control connection 372 of the second switch 360 may not be logical opposites. For example, both the first switch 340 and the second switch 370 may be "turned off" to decouple the common connection 310 from both the first connection 320 and the second connection 330. Both the switches 340 and 370 may be turned off when the system in which the device 300 is used is inactive to protect other devices in the system from damage caused by a malicious signal or an electromagnetic pulse.

Alternatively, the first switch 340 and the second switch 370 may comprise only two of many switches used in the device 300, and both the first switch 340 and the second switch 370 may be switched to open circuits while an n-th switch (not shown) is selected for routing a signal from the common connection 310 to an n-th connection (not shown) associated with an n-th switch. Alternatively, to further improve isolation between the common connection 310 and the first connection 320 and the second connection 330, more than two shunt transistors could be used. Three or more shunt transistors could be used to selectively shunt the first transmission line 360 and the second transmission line 390 to the relative ground 362. To further enhance isolation, additional quarter-wavelength connection lengths could be employed. As in the case of the other quarter-wavelength connection lengths, an additional connection length may be inserted between a point where an additional shunt transistor is coupled to the transmission line and a point where an adjacent shunt transistor was already coupled to the transmission line.

The anticipated operating wavelengths of the first switch 340 and the second switch 370 may be different or the same. For example, when a transceiver (not shown) coupled to the common connection 310 operates at different wavelengths different antennae coupled to different connections may be selected for appropriate wavelengths. Alternatively, the anticipated operating wavelengths may be the same, such as when multiple transceivers may share a common antenna coupled to the common connection 310. The transceivers may then be selectively isolated from one another using the switches 340 and 370.

Figure 4A:
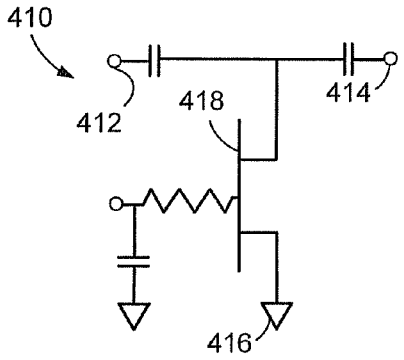
FIG. 4A is schematic diagram for a switch using a shunt configuration.
Figure 4B:
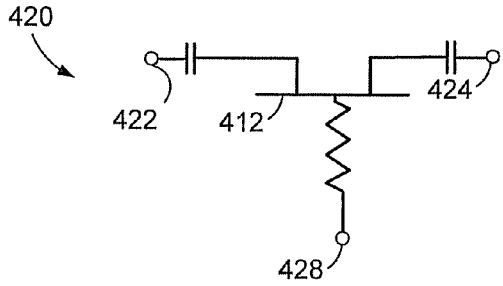
FIG. 4B is a schematic diagram for a switch using a series configuration.

FIG. 4A is a schematic diagram for a switch using a shunt configuration 410. The switch using the shunt configuration 410, as previously described, selectively couples a first transmission connection 412 and a second transmission connection 414 to relative ground 416 using a transistor 418 to effectively create a short circuit between the transmission connections 412 and 414. FIG. 4B is a schematic diagram for a switch using a series configuration 420. The switch using the series configuration 420 selectively couples a first transmission connection 422 to a second transmission connection 424 by closing a transistorized switch 412 with a control input 428. Both the switch using the shunt configuration 410 of FIG. 4A and the switch using the series configuration 420 of FIG. 4B will serve to selectively open or close a transmission line between the first transmission connections 412 and 422 and the second transmission connections 414 and 424, respectively. Also, in high-power applications as previously described, GaN-based transistors will work to accommodate high-power signals in either the switch using the shunt configuration 410 of FIG. 4A or the switch using the series configuration 420 of FIG. 4B. However, as shown in graphs 440 of FIG. 4C and graph 460 of FIG. 4D, the switch using the shunt configuration 410 of FIG. 4A and the switch using the series configuration 420 of FIG. 4B present different insertion loss and isolation characteristics.

Figure 4C:
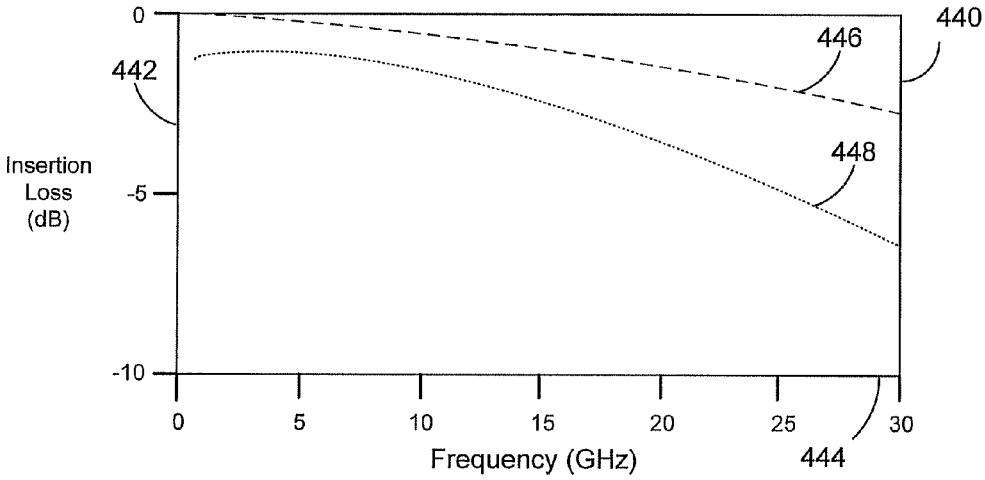
FIG. 4C is a graph comparing insertion loss over a range of frequencies for the switch using the shunt configuration of FIG. 4A and for the switch using the series configuration of FIG. 4B.

FIG. 4C is a graph 440 comparing the insertion loss over a range of frequencies for the switch using the shunt configuration 410 of FIG. 4A and the switch using the series configuration 420 of FIG. 4B. The graph 440 shows an insertion loss presented in decibels (dB) plotted on a vertical axis 442 over a frequency range presented in gigahertz (GHz) plotted on a horizontal axis 444. The insertion loss represents the signal lost over a switching device when the device is closed to conduct an applied signal. The insertion loss for the switch using the shunt configuration 410 is represented by a dashed line 446 while the insertion loss for the switch using the series configuration 420 is represented by a dotted line 448. As shown in the graph 440, at every depicted frequency, the dashed line 446 representing the insertion loss for the switch using the shunt configuration 410 is lower than the insertion loss represented by the dotted line 448 for the switch using the series configuration 420. Thus, to reduce insertion loss, the switch using the shunt configuration 410 is a preferable configuration at all frequencies shown.

Figure 4D:
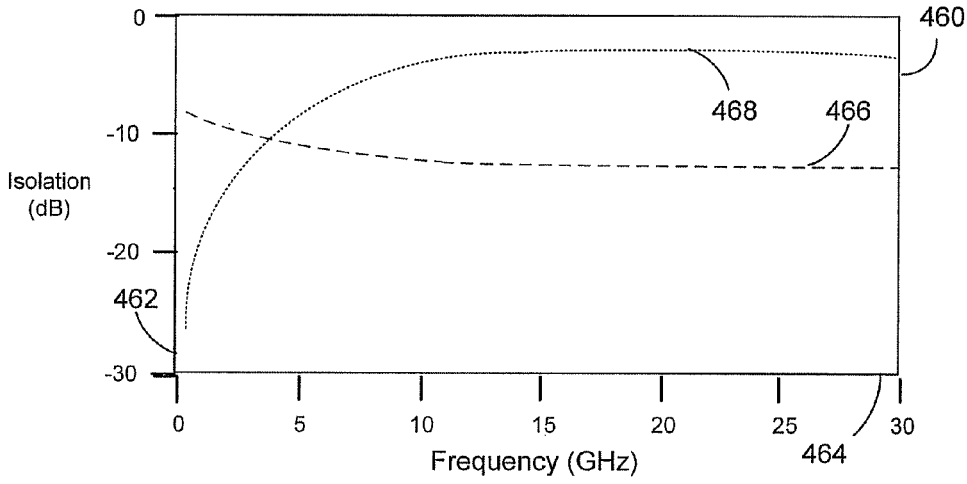
FIG. 4D is a graph comparing isolation over a range of frequencies for the switch using the shunt configuration of FIG. 4A and for the switch using the series configuration of FIG. 4B.

FIG. 4D is a graph 460 comparing the isolation over a range of frequencies for the switch using the shunt configuration 410 of FIG. 4A and the switch using the series configuration 420 of FIG. 4B. The graph 460 shows isolation presented in decibels (dB) plotted on a vertical axis 462 over a frequency range presented in gigahertz (GHz) plotted on a horizontal axis 464. The isolation represents the signal lost over a switching device when the device is open and, thus, when it is desired not to conduct a signal. The isolation for the switch using the shunt configuration 410 is represented by a dashed line 466 while the isolation for a switch using the series configuration 420 is represented by a dotted line 468. As shown in the graph 460, at most frequencies (and all plotted frequencies over approximately five gigahertz), the dashed line 466 representing the isolation for the switch using the shunt configuration 410 is lower than the dotted line 468 representing the isolation for the switch using the series configuration 420. Thus, to improve isolation, the switch using the shunt configuration 410 is a preferable configuration at most frequencies.

Figure 5A:
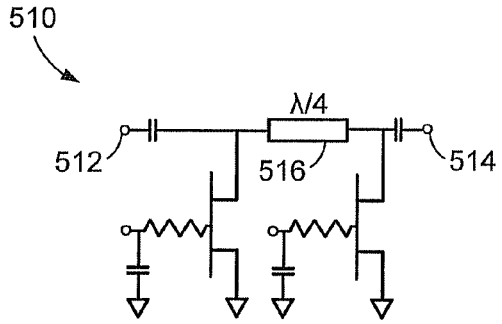
FIG. 5A is a schematic diagram for a switch using a shunt configuration with a quarter-wavelength connection length in the transmission line.
Figure 5B:
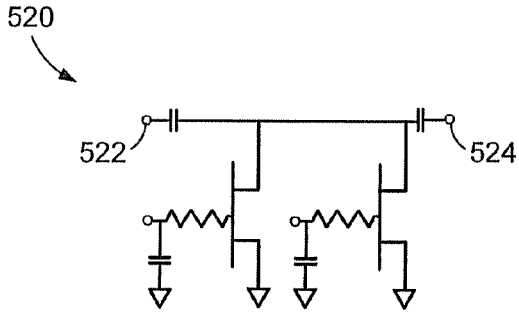
FIG. 5B is a schematic diagram for a switch using a shunt configuration without a quarter-wavelength connection length in the transmission line.

FIG. 5A is a schematic diagrams for a switch using a shunt configuration with a quarter-wavelength connection length in the transmission line 510. The switch using the shunt configuration with the quarter-wavelength connection length in the transmission line 510, as previously described, improves isolation when the switch is open and, thus, shunts a transmission line to ground. The switch using the shunt configuration and with the quarter-wavelength connection length in the transmission line 510 positions a quarter-wavelength connection 516 between a first connection 512 and a second connection 514. FIG. 5B is a schematic diagram for a switch using a shunt configuration without a quarter-wavelength connection length in the transmission line 520. The switch using the shunt configuration without a quarter-wavelength connection length in the transmission line 520 has no specified connection length between a first connection 522 and a second connection 524. As shown in graph 540 of FIG. 5C and graph 560 of FIG. 5D, the different configurations present different insertion loss and isolation characteristics.

Figure 5C:
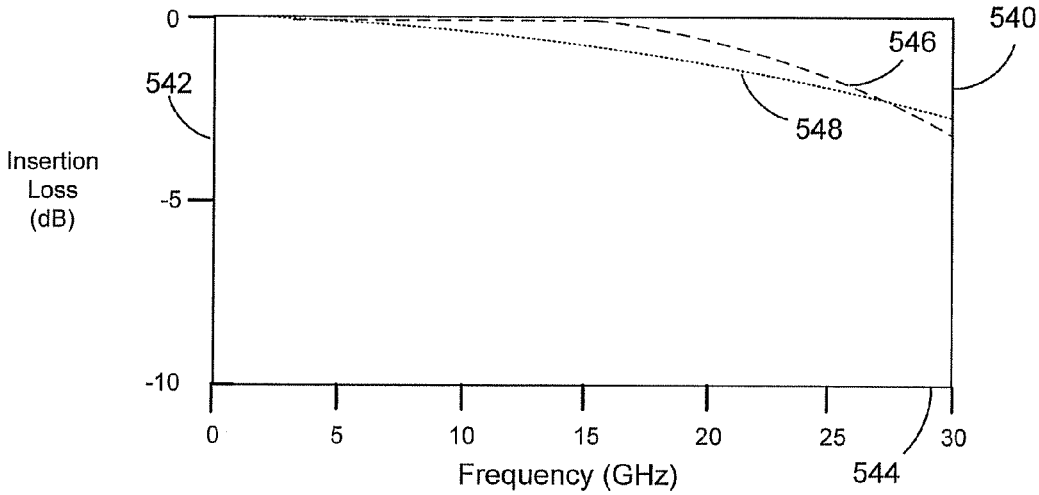
FIG. 5C is a graph comparing the insertion loss over a range of frequencies for the switch using the shunt configuration with the quarter-wavelength connection length in the transmission line of FIG. 5A and the switch using the shunt configuration without the quarter-wavelength connection length in the transmission line of FIG. 5B.

FIG. 5C is a graph comparing the insertion loss of the switch using the shunt configuration with the quarter-wavelength connection length in the transmission line 510 of FIG. 5A with the insertion loss of the switch using the shunt configuration without the quarter-wavelength connection length in the transmission line 520 of FIG. 5B. The graph 540 shows an insertion loss presented in decibels (dB) plotted on a vertical axis 542 over a frequency range presented in gigahertz (GHz) plotted on a horizontal axis 544. Again, the insertion loss represents signal loss over a switching device when the device is closed to conduct an applied signal. The insertion loss for the switch using the shunt configuration with the quarter-wavelength connection length in the transmission line 510 is represented by a dashed line 546. The insertion loss for the switch using the shunt configuration without the quarter-wavelength connection length in the transmission line 520 is represented by a dotted line 548. As shown in the graph 540, at every depicted frequency except for high frequencies above 25 GHz, the dashed line representing the insertion loss 546 for the switch using the shunt configuration with quarter-wavelength connection length in the transmission line 510 is lower than the dotted line presenting the insertion loss 548 for the switch using the shunt configuration without the quarter-wavelength connection length in the transmission line 520. Thus, to reduce insertion loss, the switch using the shunt configuration with the quarter-wavelength connection in the transmission line 510 is a preferable configuration at most frequencies, and at all frequencies under approximately 25 gigahertz.

Figure 5D:
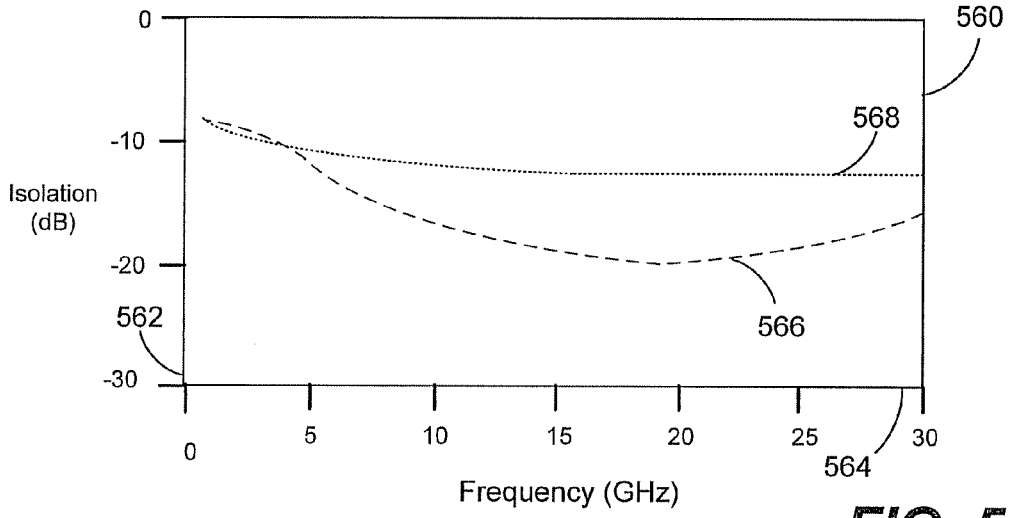
FIG. 5D is a graph comparing isolation over a range of frequencies for the switch using the shunt configuration with the quarter-wavelength connection length in the transmission line of FIG. 5A and the switch using the shunt configuration without the quarter-wavelength connection length in the transmission line of FIG. 5B.

FIG. 5D is a graph 560 comparing isolation over a range of frequencies for the switch using the shunt configuration with the quarter-wavelength connection length in the transmission line 510 of FIG. 5A and the switch using the shunt configuration without the quarter-wavelength connection length in the transmission line 520 of FIG. 5B. The graph 560 shows isolation presented in decibels (dB) plotted on a vertical axis 562 over a frequency range presented in gigahertz (GHz) plotted on a horizontal axis 564. Again, the insertion represents signal loss over a switching device when the device is open and, thus, when it is desired not to conduct a signal. The isolation for the switch using the shunt configuration with the quarter-wavelength connection length in the transmission line 510 is represented by a dashed line 566. The isolation for a switch using the shunt configuration without the quarter-wavelength connection length in the transmission line 520 is represented by a dotted line 568. As shown in the graph 560, at most frequencies (and all plotted frequencies over approximately five gigahertz), the dashed line 566 representing the isolation switch using the shunt configuration with the quarter-wavelength connection length in the transmission line 510 is higher than the dotted line 568 representing the isolation for the switch using the shunt configuration without the quarter-wavelength connection length in the transmission line 520. Thus, to increase isolation, the switch using the shunt configuration with the quarter-wavelength connection length in the transmission line 510 is a preferable configuration at most frequencies.

Figure 6:
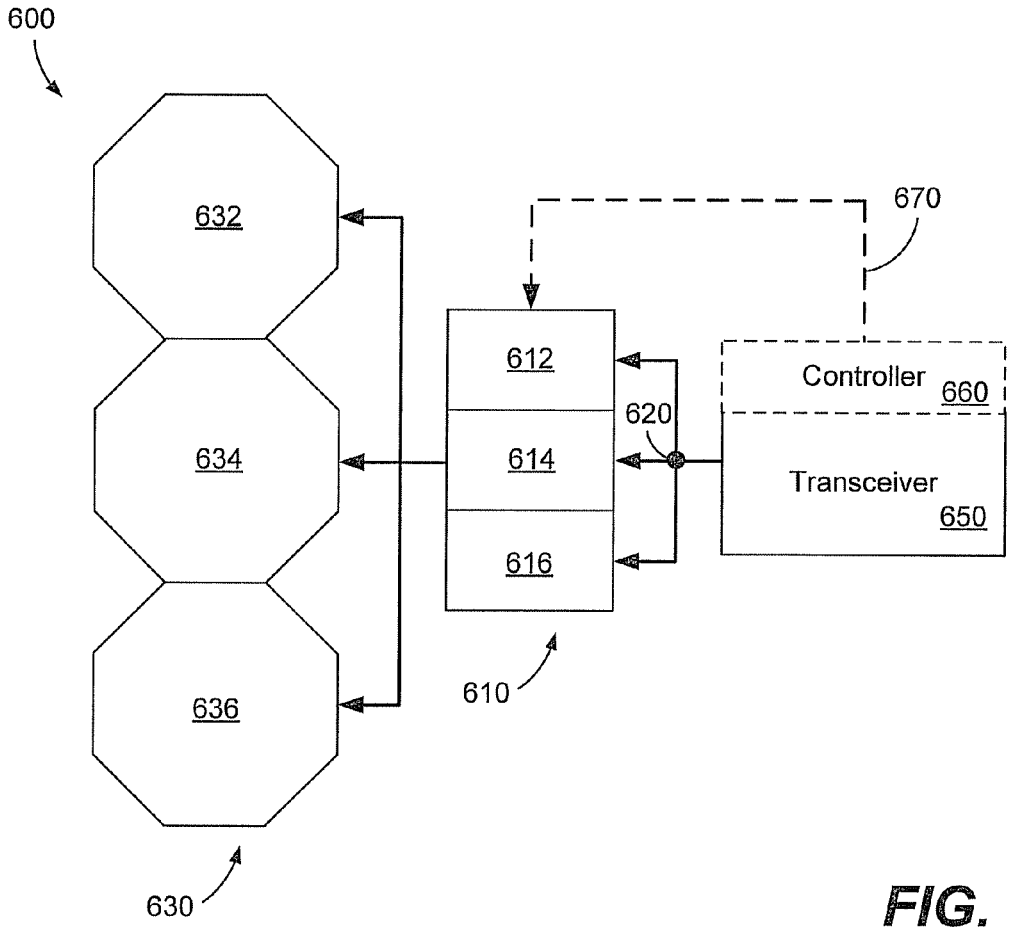
FIG. 6 is block diagram of a particular embodiment of a GaN-transistor-based switching system for use with a phased array antenna and a transceiver.

FIG. 6 is block diagram of a particular embodiment of a system 600 in which a GaN-transistor-based switching system 610 is used with a phased array antenna 630 and a transceiver 650. As previously described, a GaN-transistor-based switching system 610 such as described with reference to FIG. 3 may be used to selectively couple a device with each of a plurality of corresponding devices, for example, to selectively couple a transceiver with a plurality of different antennae. In the example of FIG. 6, the transceiver 650 is selectively coupled to elements 632-636 of a phased-array antenna 630. The GaN-transistor-based switching system 610 includes a plurality of switches 612-616 as described with reference to FIG. 3. The plurality of switches 612-616 of the GaN-transistor-based switching system 610 are coupled to the transceiver 650 at a common transmission point 620. The transceiver 650, which may include a controller 660 that selectively applies control signals via a control line 670 to the GaN-transistor-based switching system 610 to select among the switches 612-616, generates or receives a signal. Based on the selection of the switches 612-616, one or more of the antenna elements 632-636 of the phased-array antenna 630 are selectively coupled to the transceiver 650. Alternatively, the antenna elements 632-636 not coupled to the transceiver are isolated from the transceiver 650. As previously described, the GaN-transistor-based switching system 610 can accommodate high-power signals while reducing insertion loss and isolation loss.

Figure 7:
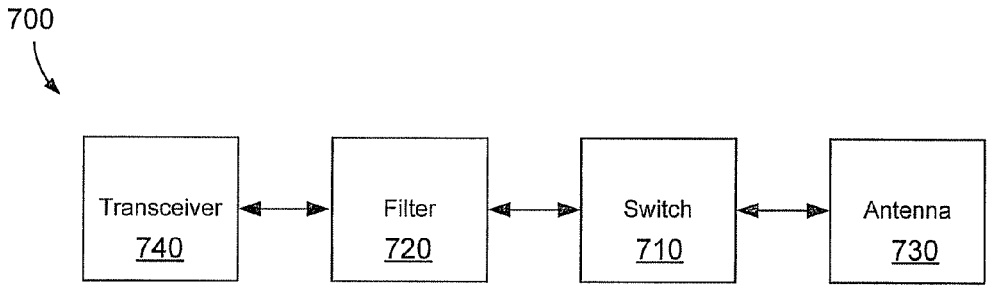
FIG. 7 is a block diagram of a particular embodiment of a GaN-transistor-based switching system for use with a bandpass filter and a bandpass-limited antenna.

FIG. 7 is a block diagram of a particular embodiment of a GaN-transistor-based switching system (designated as the "switch" 710 in FIG. 7) used with a bandpass filter 720 and a bandpass-limited antenna 730 to further isolate a transceiver 740 or other device from undesired signals. As previously described, a shunt configuration including one or more quarter-wavelength transmission connections provides effective isolation of devices coupled to the switch when the switch is configured as an open switch. Additional devices, such as bandpass filters and a bandpass-limited antenna may be used to enhance the isolation of the devices.

A transceiver 740 may be configured to operate within a desired range of frequencies. As previously described, knowing an anticipated frequency of operation, one can determine an anticipated wavelength at which the transceiver 740 will operate and can select a quarter-wavelength connection for use in the switch 710 to improve device isolation. To attenuate signals outside an anticipated range of operation, a bandpass filter 720 may be coupled between the switch 710 and the transceiver 740 to attenuate any signals that fall outside the anticipated frequency range of operation. The filter 720 may also include a high-pass or a low-pass filter, or any combination of filters, to isolate the transceiver from undesired signals. Similarly, in addition to or instead of using a filter 720, a bandpass-limited antenna 730 may be used to attenuate signals outside the anticipated operating range of the system 700.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the illustrations or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

In the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. A device, comprising:

a first transmission line configured to connect a common connection and a first connection, the first transmission line including at least one capacitor configured to at least partially block direct current components of a signal applied to the first transmission line;

a first Gallium Nitride-based (GaN-based) transistor, the first GaN-based transistor having a first terminal coupled to the first transmission line at a first point, a second terminal configured to be coupled to a relative ground, and a third terminal configured to be coupled to a first control connection; and a second GaN-based transistor, the second GaN-based transistor having a first terminal coupled to the first transmission line at a second point, a second terminal configured to be coupled to the relative ground, and a third terminal configured to be coupled to the first control connection.

2. The device of claim 1, wherein the first transmission line has a first connection length between the first point and the second point, the first connection length being selected based on an anticipated operating wavelength of the first transmission line.

3. The device of claim 2, wherein the first connection length is a quarter -wavelength connection length.

4. The device of claim 1, wherein the first control connection is configured to receive a first signal or a second signal, wherein:

when the first control connection receives the first signal, the first GaN-based transistor and the second GaN-based transistor are configured to electrically disconnect the first transmission line from the relative ground, causing the first transmission line to electrically connect the common connection with the first connection; and when the first control connection receives the second signal, the first GaN-based transistor and the second GaN-based transistor are configured to electrically connect the first transmission line to the relative ground, causing the first transmission line to electrically disconnect the common connection from the first connection.

5. The device of claim 4, further comprising a second connection length between the first point on the first transmission line and the common connection, wherein the second connection length comprises a quarter-wavelength connection length.

6. The device of claim 5, further comprising:

a second transmission line configured to connect the common connection and a second connection, the second transmission line including at least one capacitor configured to at least partially block direct current components of a signal applied to the second transmission line;

a third Gallium Nitride-based (GaN-based) transistor, the third GaN-based transistor having a first terminal coupled to the second transmission line at a third point, a second terminal configured to be coupled to the relative ground, and a third terminal configured to be coupled to a second control connection; and a fourth GaN-based transistor, the fourth GaN-based transistor having a first terminal coupled to the second transmission line at a fourth point, a second terminal configured to be coupled to the relative ground, and a third terminal configured to be coupled to the second control connection.

7. The device of claim 6, wherein:

the second transmission line comprises a third connection length between the third point and the fourth point, the third connection length being based on a second anticipated operating wavelength; and the second transmission line comprises a fourth connection length between the common connection and the third point, the fourth connection length being based on the second anticipated operating wavelength.

8. The device of claim 7, wherein the third connection length and the fourth connection length comprise approximately one quarter of the second anticipated operating wavelength.

9. The device of claim 6, wherein the second control connection receives a third signal that comprises a logical opposite of the first signal received by the first control connection, wherein:

when the first control connection receives the first signal causing the common connection to be connected to the first connection, the second control connection receives the third signal, causing the third GaN-based transistor and the fourth GaN-based transistor to electrically connect the second transmission line to the relative ground, causing the second ransmission line to electrically disconnect the common connection from the second connection; and when the first control connection receives the second signal causing the common connection to be disconnected from the first connection, and the second control connection receives a fourth signal, causing the third GaN-based transistor and the fourth GaN-based transistor to electrically disconnect the second transmission line from relative ground, causing the second transmission line to electrically connect the common connection to the second connection.

10. The device of claim 7, wherein:

the common connection is coupled to a transceiver and the first connection and the second connection are each coupled to a separate antenna segment; and the common connection is coupled to an antenna, the first connection is coupled to a transmit side of the transceiver, and the second connection is coupled to a receive side of the transceiver.

11. The device of claim 1, wherein at least one of:

a filter is coupled to the common connection, the filter being configured to attenuate an undesired signal applied to the first transmission line having an undesired signal wavelength outside a range the first transmission line is anticipated to transmit; and an antenna is coupled to the first connection, the antenna being configured to attenuate the undesired signal wavelength outside the range the first transmission line is anticipated to transmit.

12. The device of claim 1, further comprising one or more additional Gallium Nitride-based (GaN-based) transistors, each of the additional GaN-based transistors having a first terminal coupled to the first transmission line at an additional point, a second terminal configured to be coupled to the relative ground, and a third terminal configured to be coupled to the first control connection.

13. An electronic device, comprising:

a first Gallium Nitride-based (GaN-based) transistor having a first terminal;

a second GaN-based transistor having a first terminal; and a transmission line connecting a common connection and a first connection, the first and second transistors being disposed in a pi-configuration with the transmission line disposed between the first terminal of the first GaN-based transistor and the first terminal of the second GaN-based transistor, wherein the first GaN-based transistor and the second GaN-based transistor are configured in a shunt configuration with the transmission line, the transmission line including at least one capacitor configured to at least partially block direct current components of a signal applied to the transmission line.

14. The electronic device of claim 13, wherein:

the common connection is coupled to the first terminal of the first GaN-based transistor;

the first connection is coupled to the first terminal of the second GaN-based transistor;

a relative ground is coupled to a second terminal of the first GaN-based transistor and a second terminal of the second GaN-based transistor; and a control connection is coupled to a third terminal of the first GaN-based transistor and a third terminal of the second GaN-based transistor, wherein a signal applied to the control connection is operable to one of selectively pass or attenuate a signal passing from the common connection to the first connection.

15. The electronic device of claim 13, wherein:

the transmission line is configured to convey a signal having an anticipated operating wavelength; and the transmission line includes a transmission connection length equal to approximately one-quarter of the anticipated operating wavelength.

16. A system, comprising:

a first electronic device, comprising:

a first Gallium Nitride-based (GaN-based) transistor;

a second GaN-based transistor; and a first transmission line connecting a common connection to a first connection, and wherein the first GaN-based transistor and the second GaN-based transistor are disposed in a pi-configuration to selectively couple the first transmission line to a relative ground, the first transmission line including at least one capacitor configured to at least partially block direct current components of a signal applied to the first transmission line; and a second electronic device, comprising:

a third GaN-based transistor;

a fourth GaN-based transistor; and a second transmission line connecting the common connection to a second connection, wherein the third GaN-based transistor and the fourth GaN-based transistor are disposed in a pi-configuration to selectively couple the second transmission line to the relative ground, the second transmission line including at least one capacitor configured to at least partially block direct components of a signal to the second transmission mission line.

17. The system of claim 16, wherein:

the first transmission line includes a first connection length between a first point at which a first terminal of the first GaN-based transistor is connected to the first transmission line and a second point at which a first terminal of the second GaN-based transistor is connected to the first transmission line, wherein the first connection length is proportional to a first anticipated operating wavelength of the first transmission line;

the first transmission line further includes a second connection length between the common connection and the first point wherein the second connection length is approximately equal to the first connection length;

the second transmission line includes a third connection length between a third point at which the third GaN-based transistor is connected to the second transmission line and a fourth point at which the second GaN-based transistor is connected to the second transmission line, wherein the third connection length is proportional to a second anticipated operating wavelength of the second transmission line; and the second transmission line further includes a fourth connection length between the common connection and the third point wherein the fourth connection length is approximately equal to the third connection length.

18. The system of claim 17, wherein:

the first connection length and the second connection length are equal to approximately one-quarter of the first anticipated operating wavelength; and the third connection length and the fourth length are equal to approximately one-quarter of the second anticipated operating wavelength.

19. The system of claim 17, wherein:

a first control connection is coupled to a third terminal of the first GaN-based transistor and a third terminal of the second GaN-based transistor;

a second control connection is coupled to a third terminal of the third GaN-based transistor and a third terminal of the fourth GaN-based transistor; and the first control connection and the second control connection separately receive a connect voltage to selectively couple the common point to at least one of the first point of the first transmission line and the second point of the second transmission line.

20. The system of claim 19, wherein the second control connection receives a second signal that comprises a logical opposite of a first signal received by the first control connection.

* * * * *